US009534389B2

(12) United States Patent
Lysemose et al.

(10) Patent No.: US 9,534,389 B2
(45) Date of Patent: Jan. 3, 2017

(54) WINDOW SYSTEM FOR MOUNTING IN AN INCLINED SURFACE OF A BUILDING PROVIDING IMPROVED LOAD TRANSFER

(71) Applicant: VKR HOLDING A/S, Horsholm (DK)

(72) Inventors: Jacob Lysemose, Middelfart (DK); Michael Nygaard, Odense C (DK)

(73) Assignee: VKR HOLDING A/S, Horsholm (DK)

( * ) Notice: Subject to any disclaimer, the term of this patent is extended or adjusted under 35 U.S.C. 154(b) by 0 days.

(21) Appl. No.: 14/915,594

(22) PCT Filed: Aug. 29, 2014

(86) PCT No.: PCT/DK2014/050261
§ 371 (c)(1),
(2) Date: Feb. 29, 2016

(87) PCT Pub. No.: WO2015/028031
PCT Pub. Date: Mar. 5, 2015

(65) Prior Publication Data

US 2016/0222668 A1 Aug. 4, 2016

(30) Foreign Application Priority Data

Aug. 30, 2013 (DK) ..... 2013 70484

(51) Int. Cl.
*E06B 1/02* (2006.01)
*E04D 13/08* (2006.01)
(Continued)

(52) U.S. Cl.
CPC ..... *E04D 13/03* (2013.01); *E04D 13/035* (2013.01); *E04D 13/0354* (2013.01); *E06B 1/02* (2013.01); *E06B 1/04* (2013.01); *E06B 1/36* (2013.01)

(58) Field of Classification Search
CPC ..... E06B 1/02; E06B 1/04; E06B 1/36; E06B 1/38; E06B 3/00; E06B 3/26; E06B 3/30; E06B 3/68; E06B 3/968; E04D 13/031; E04D 13/1415; E04D 13/08; E04D 13/0357; E04D 13/0354; E04D 13/0305
See application file for complete search history.

(56) References Cited

U.S. PATENT DOCUMENTS 3,844,087 A * 10/1974 Schultz ..... E04D 3/08 52/200
4,300,440 A * 11/1981 Holter ..... B60J 7/1642 114/201 R
(Continued)

FOREIGN PATENT DOCUMENTS

EP 2383401 A2 11/2011
EP 2472043 A1 7/2012
(Continued)

*Primary Examiner* — Phi A
(74) *Attorney, Agent, or Firm* — Timothy D. St. Clair; Nexsen Pruet, LLC

(57) ABSTRACT

A window system for mounting in an inclined surface of a building, said window system comprising a frame structure and a sash structure each defining a substantially rectangular unit with an inner opening, and where a transverse element extending between side members of the sash structure forms a yoke (25) in connection with the pane element (1) and acts as a support of the pane element to transfer at least part of the load of the pane element to the side members (22) of the sash structure (2). At least one glazing support (14) may be mounted on the yoke (25), each glazing support (14) preferably comprising a substantially plane abutment portion (141) in contact with the pane element (1) and a first engagement portion (142) adapted to engage the yoke (25).

25 Claims, 7 Drawing Sheets

(51) Int. Cl.

| | |
|---|---|
| ***E04D 13/03*** | (2006.01) |
| ***E04D 13/035*** | (2006.01) |
| *E06B 1/36* | (2006.01) |
| *E06B 1/04* | (2006.01) |

(56) References Cited

U.S. PATENT DOCUMENTS 4,995,208 A * 2/1991 Sampson ..... E04D 13/0315 52/200
5,044,133 A * 9/1991 Sampson ..... E04D 13/0305 49/495.1
5,148,643 A * 9/1992 Sampson ..... E04D 13/031 49/495.1
5,207,036 A * 5/1993 Sampson ..... E04D 13/0354 49/402
5,355,644 A * 10/1994 Guhl ..... E04D 13/1415 52/200
5,638,645 A * 6/1997 Lipton ..... E04D 13/0354 454/339
5,913,785 A * 6/1999 Møller ..... E04D 13/0305 49/DIG. 1
6,427,415 B1 8/2002 Rosenkranz
6,904,725 B1 * 6/2005 Hansen ..... E04D 13/0357 49/153
2003/0014930 A1 * 1/2003 Richardson ..... E04D 3/08 52/198
2006/0242918 A1 * 11/2006 Richardson ..... E04D 3/08 52/200
2012/0167495 A1 * 7/2012 Lindgren ..... E04D 13/031 52/200
2014/0366468 A1 * 12/2014 Lindgren ..... E06B 1/603 52/200

FOREIGN PATENT DOCUMENTS

FR 2615225 A1 11/1988
WO 9007035 A1 6/1990

* cited by examiner

WINDOW SYSTEM FOR MOUNTING IN AN INCLINED SURFACE OF A BUILDING PROVIDING IMPROVED LOAD TRANSFER

The present invention relates to a window system for mounting in an inclined surface of a building, said window system comprising: a frame structure including a plurality of frame members and a sash structure including a plurality of sash members, the frame structure and the sash structure each defining a substantially rectangular unit with an inner opening, a lower edge intended to face downwards in the mounted state of the window, an upper edge intended to face upwards in the mounted state of the window, and two side edges extending between the lower and upper edges, and a pane element having an upper edge, a lower edge and two side edges.

Such a window system, in which example a motor operator is arranged on the outer side of the sash and frame structures to be concealed for the user of the window is described for example in EP2472043A1. This window works very well, but the system of covering and flashing members used for protecting the motor and like devices arranged on the outer side of the frame structure is relatively complex. More important even, the load distribution in the window has proven to pose great demands on the parts of the window, in particular in some fields of application.

It is therefore the object of the invention to provide a window with an improved distribution of the loads.

This is achieved with a window wherein a transverse element extending between side members of the sash structure forms a yoke in connection with the pane element and acts as a support of the pane element to transfer at least part of the load of the pane element to the side members of the sash structure.

In particular when the window system is mounted in large inclinations, the load emanating from the weight of the pane element is substantial. By the invention, the supporting function of the sash bottom member may be dispensed with, either in part or in full. In turn, this entails a substantially increased degree of freedom in the configuration of the sash bottom member.

Presently preferred embodiments and further advantages will be apparent from the following detailed description and the dependent claims.

The invention will be described in more detail below by means of a non-limiting example of an embodiment and with reference to the schematic drawing, in which FIG. 1 is a perspective view showing three window systems installed as a group with one common covering and flashing assembly, FIG. 2 shows one of the window systems in FIG. 1 with associated flashing members, FIG. 3 is a cross-sectional view along the line III-III in FIG. 2, but where side members of the sash and frame and side covering members have been removed, FIG. 4 is a cross-sectional view along the line IV-IV in FIG. 1, but where side members of the sash and frame and side covering members have been removed, FIG. 5 is a perspective view of the frame extension element, FIG. 6 is a partial perspective view of the lower portion of the window system;

Figure 1:
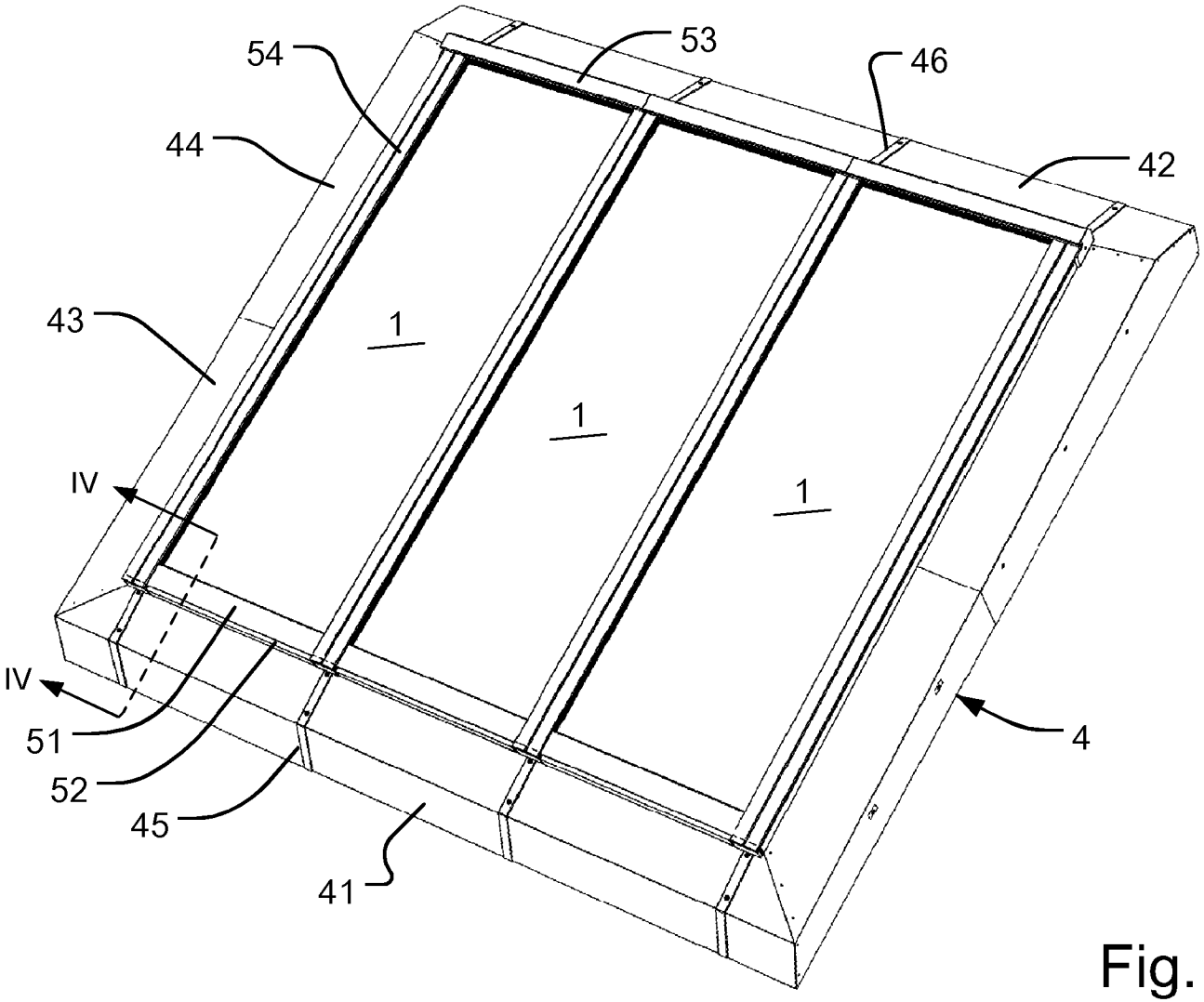
Figure 2:
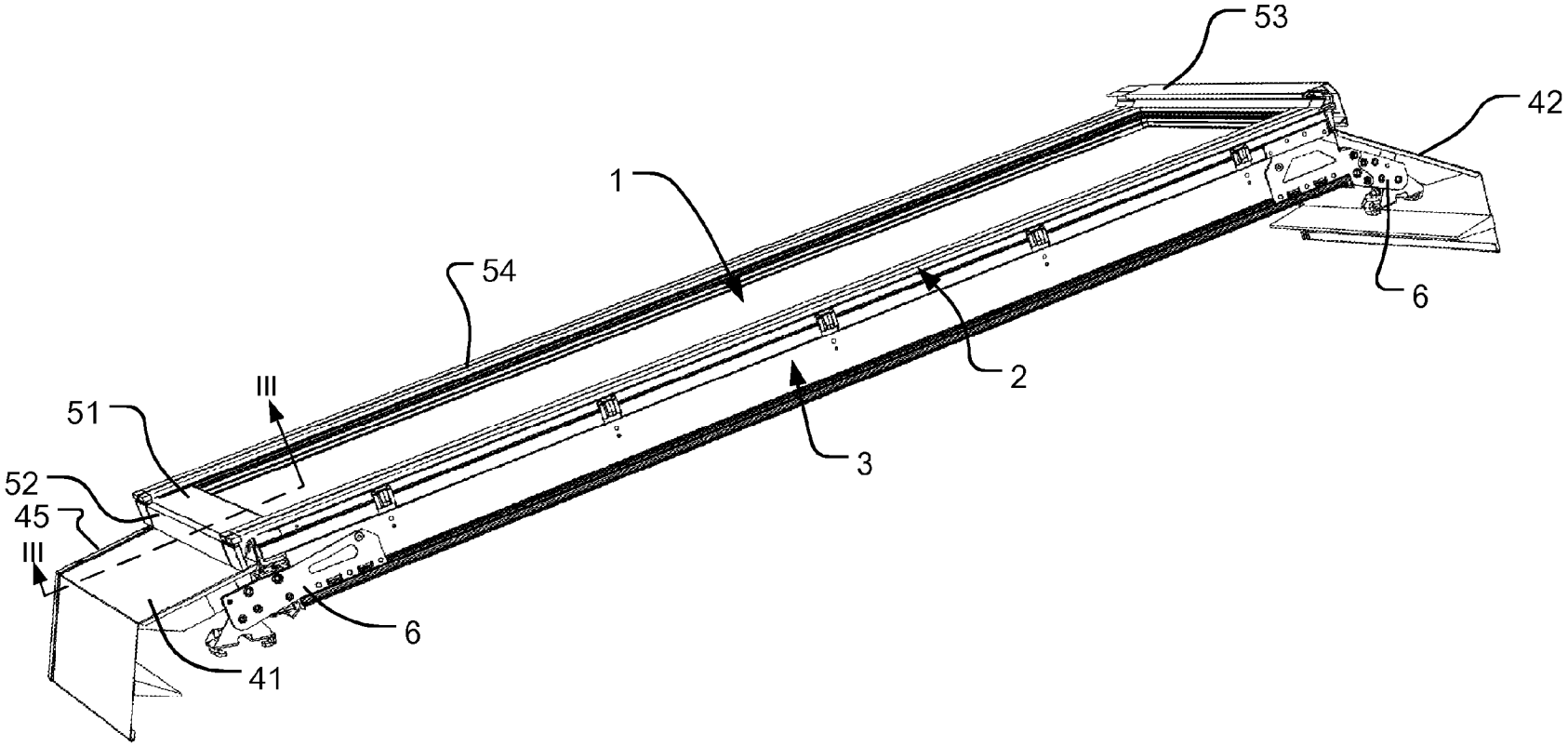

A series of three window systems according to the invention is shown in FIG. 1 and the centre window system, in the following also referred to as window only, is shown from a slightly different angle in FIG. 2. Each window comprises a pane element 1 encased in a sash structure 2, which is connected to a frame 3. A covering and flashing assembly 4 includes a plurality of flashing members 41-46 used for bridging the gap between the windows and the building surface (not shown) in which they are mounted and a plurality of covering members 51-54 used to cover exterior surfaces of the windows. Mounting brackets 6 are provided at each corner of the window.

In the embodiment shown the flashing members 41-46 and the mounting brackets 6 are adapted for installation of the windows on a so-called upstand (not shown), which is a load-bearing frame construction typically formed on a roof with limited inclination as described for example in EP2472027. It is however to be understood that the present invention works equally well in other installation situations, where the flashing assembly and mounting brackets are of a different configuration.

Figure 3:
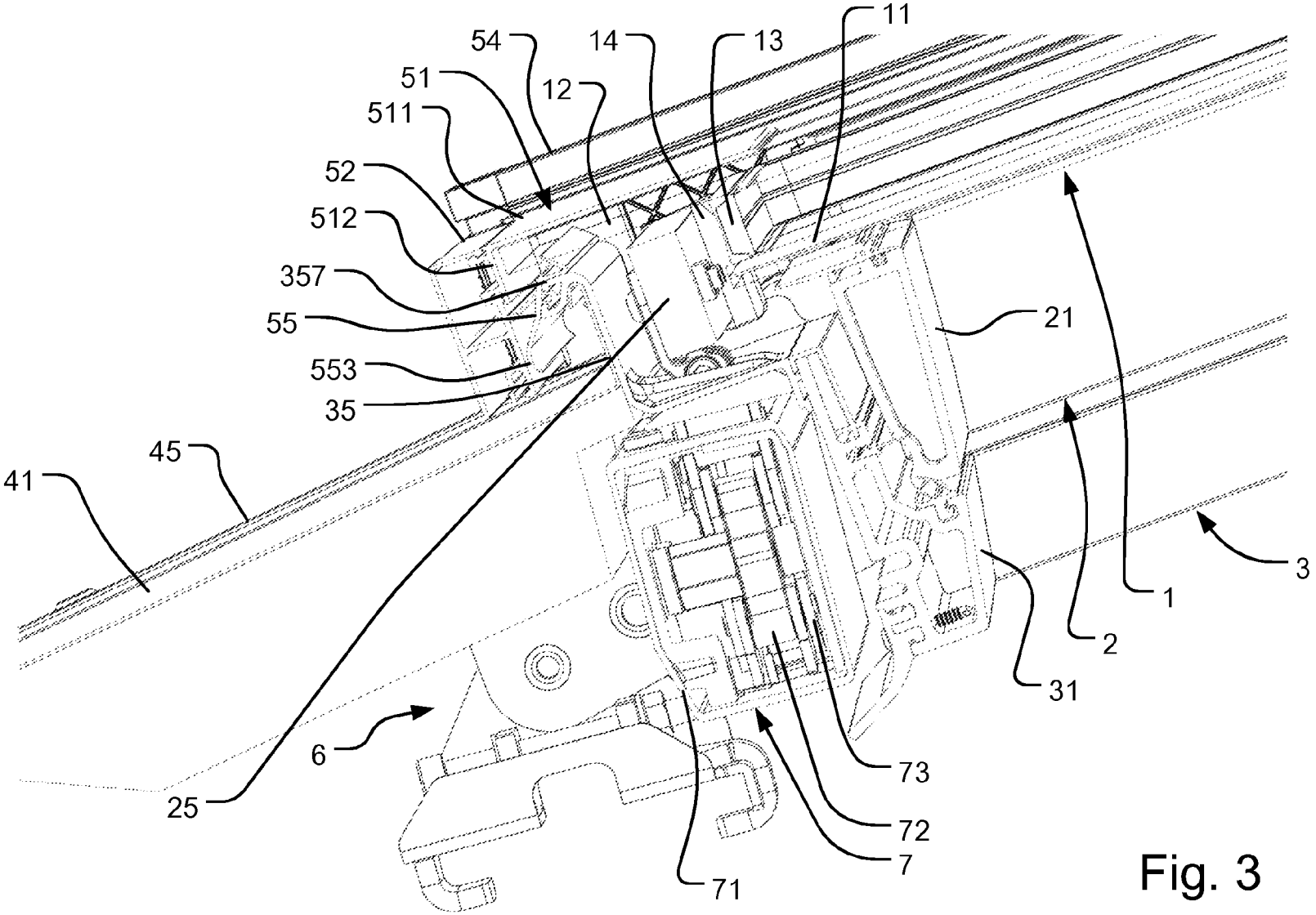

Turning now to FIG. 3, which shows a sectional view of the bottom parts of the centre window of FIG. 1, the operator 7 is seen on the outer side of the frame bottom member 31 at the lower edge of the pane element 1. The operator includes an operator housing 71, a motor 72 and a chain 73. The chain transmits forces from the motor to a transverse element forming a yoke 25, which in the embodiment shown has a supporting function in addition to the sash structure 2 but may even provide the sole supporting function to the pane element 1 at the lower edge of the window system.

When mounting windows in groups as in FIG. 1 it is common to make some of the windows as passive units without hinges and operators to reduce both the initial price and cost for maintenance and repairs. In a group of three windows as in FIG. 1, the centre window will typically be an active window with operator, whereas the left and right windows will be passive. In such cases the space occupied by the operator housing 71 in active windows may be filled with an insulating member in the passive windows. Accordingly, the outlines of the operator housing in FIG. 4 may also be seen as representing such an insulating member.

Figure 4:
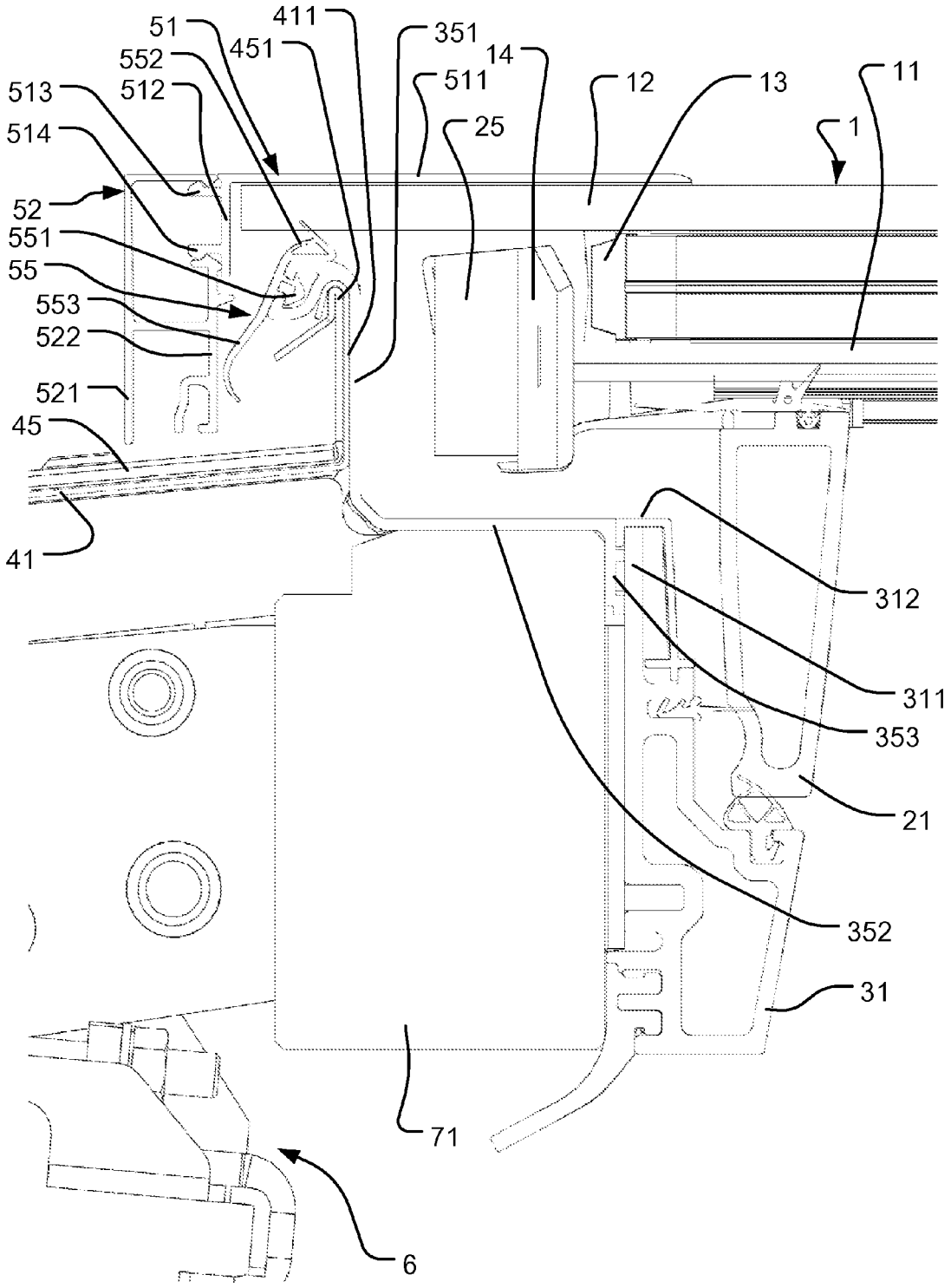

In FIGS. 3 and 4 the pane element 1 includes two sheet elements 11, 12 separated by a spacer 13. The interior sheet element 11, which for safety reasons consists of laminated glass, just projects over the lower edges of the sash bottom member 21 and the frame bottom member 31, while the exterior sheet element 12 projects somewhat further and covers the operator 7. A pane element of this type is known as a stepped pane.

In the embodiment shown, the lower edge of the interior sheet element 11 abuts a glass holder in the form of glazing support 14 arranged on the yoke 25. When the window is mounted with a steep inclination the provision of the glazing support 14 allows the yoke 25 to carry at least some of the weight of the pane element, thereby minimizing or even eliminating the forces on the actual sash members. Also in other inclinations, the yoke 25 carries the weight and possibly other loads on the pane element 1 as well.

It is to be understood that the invention also applies to windows, where only one sheet element of a stepped pane element 1 projects over the sash 2 and frame 3, and to windows with a traditional non-stepped pane element. In the first case the interior sheet element 11 may then be arranged to abut the sash bottom member 21 as described for example in DE10059849A1, and in the latter case the yoke will be on the interior side of the interior sheet element. The use of a traditional non-stepped pane element has the advantage that this type of pane is cheaper than a stepped pane, but as will be apparent from FIG. 4 there will then be less room for the operator, or alternatively the sash will have to be higher to make room for the yoke, thus making the window construction more bulky.

A bottom sash covering comprising two covering members 51, 52 is provided at the lower edge of the exterior sheet element 12, which forms the lower edge of the window as such.

One covering member 51 has the shape of an L and is attached with its longer leg to the exterior surface of the exterior sheet element by means of an adhesive. As it is of very flat design, water on the exterior pane surface will run over it substantially without meeting any resistance. The shorter leg of the L enveloping the lower edge of the exterior sheet element 12, projecting downwards towards a flashing member 41 which is embodied substantially as described in EP2472027 and which will therefore not be described in further detail here. If designed appropriately, this first covering member 51 might in principle be sufficient, but in the embodiment shown, a second covering member 52 is attached to its shorter leg.

The second covering member 52 is here attached to the first covering member 51 by a snap-locking engagement with a pair of barbed legs 511, 512 thereon, but it will be understood that other means of attachment, including adhesives and even welding, are also possible.

A two-part covering with a releasable interconnection is presently preferred, since it allows removal of the second covering member 52 for maintenance of the connection between the operator chain 73 and yoke 25. The second covering member 52 shown in FIGS. 3 and 4 has two legs 521, 522 projecting towards the flashing member 41, the first leg 521 forming the lower outer surface of the window structure. The second inner leg 522 has the shape on an inverted Y, meaning that a total of three leg end edges are located a short distance above the exterior surface of the bottom flashing member 41. This provides a very effective labyrinth sealing where the formation of air whirls, will prevent water, snow and dirt from being forced up underneath the covering under the influence of wind.

Also contributing to the labyrinth seal is a frame extension element 35, which projects from the frame bottom member 31, over the operator housing 71 and almost up to the lower edge of the exterior sheet element 12 of the pane element. Wind blowing against the window from the left in FIGS. 3 and 4 will thus not only have to pass the whirl chambers formed between the flashing member 41 and the legs 521, 522 of the second covering member 52. It will also have to come up between the second leg 522 of the second covering member and a first leg 351 of the frame extension member 35, which extends substantially perpendicularly to the plane of the pane element, and turn at the distal end edge thereof in order to enter the window structure.

Here the flashing member 41 has an upstanding leg 411, the end of which is held in a bend at the distal end of a first leg 351 of the frame extension element, thus providing a very reliable and water tight connection, but this need not be the case. Flashing connectors 45, which are seen most clearly in FIG. 1, are also provided with a leg 451 held in the bend in a similar manner as shown in FIG. 4.

Figure 5:
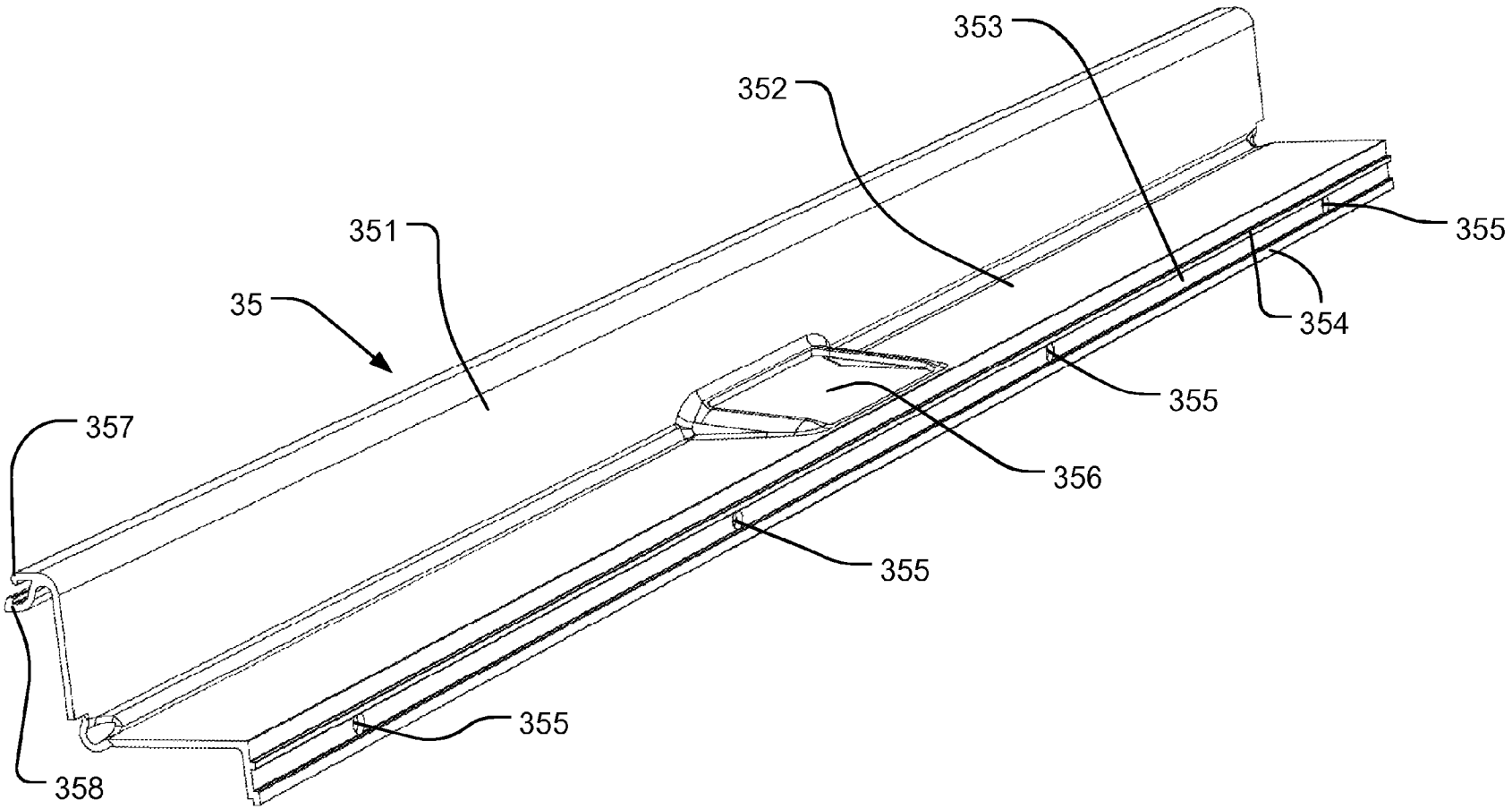

In this embodiment, which is shown in more detail in FIG. 5, the frame extension element 25 has the overall shape of a Z with a second leg 352 extending over the operator housing 71 substantially in parallel to the pane element 1 and a third leg 353 being used for attachment to the outer side 311 frame bottom member 31. The third leg is here provided with two longitudinal projections 354 and a series of openings 355, which allows it to be attached to the frame bottom member by means of screws, but it will be understood that other means of attachment are possible. It is also to be understood that the third leg may be left out entirely and that the second leg may then be attached to the exterior side 312 of the frame bottom member or even to the operator housing if designed appropriately.

As will also be seen from FIGS. 3 and 5 the second leg 352 of the frame extension member 35 is provided with an opening 356 through which the operator chain 73 may pass, but it is also possible to simply interrupt the second leg or even the entire frame extension member at this place. In passive windows the frame extension element may be continuous without openings or interruptions.

At the distal end of the first leg 351 of the frame extension element is split in two so that the two end edges 357, 358 form a longitudinal groove. This groove is adapted for receiving a projection 551 on a sealing element 55 as shown in FIGS. 3 and 4.

The sealing element 55 further improves the tightness of the construction by sealing the small gap left between the frame extension member 35 and the covering members 51, 52 and/or the pane element 1. In this embodiment a head 552 of the sealing element is in engagement with the interior side of the exterior sheet element 112 in the closed state of the window and a tail 553 of the sealing element is adapted for engagement with the second covering member 52. The tail 553 of the sealing element is bent back from the second covering element 52 to prevent it from sticking to the covering and being torn when the window is opened and closed repeatedly.

The design of the sealing element 55 shown in FIGS. 3 and 4 and described above is adapted for use in a window structure with a covering, but it will be understood that the combination of the frame extension element 35 and a sealing element could alone lead to a satisfactory water proofing of the window. In that case the tail 553 of the sealing element could be dispensed with and the groove formed by the two ends 357,358 of the first leg 351 of the frame extension element could advantageously be facing upwards towards the interior side of the exterior sheet element 12. It would also be advantageous to make the exterior sheet element 12 of the pane element 1 project even further in order to reduce the weather exposure of the sealing element.

In the above the different element used for water proofing the window has been described primarily with reference to the cross-sections in FIGS. 3 and 4, but is it to be understood that the covering and sealing elements extending substantially in parallel with the frame bottom member over substantially the entire length thereof. Likewise it is to be understood that separate end closure elements may be provided at the corners of the window, but the overlap of the side covering members 54 shown in FIG. 1 will often be sufficient.

Referring now to FIGS. 6 to 11, the configuration of the yoke 25, the yoke fitting 250 and the glazing support 14 will be described in further detail.

Figure 6:
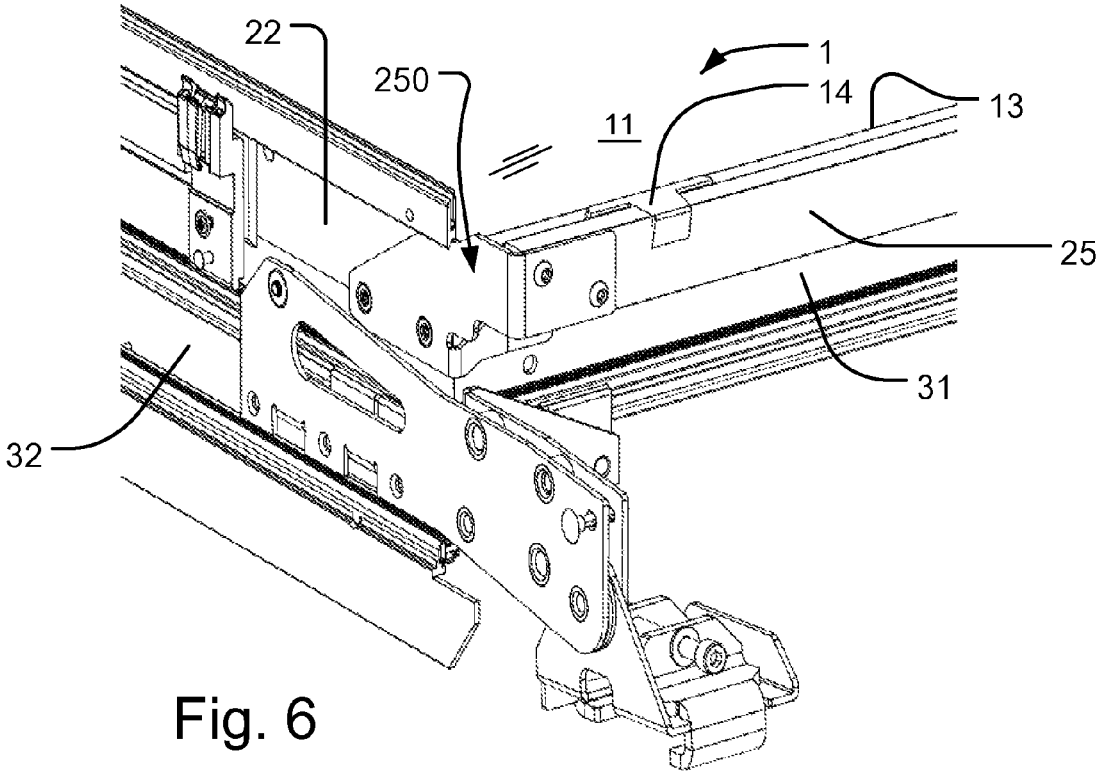
Figure 7:
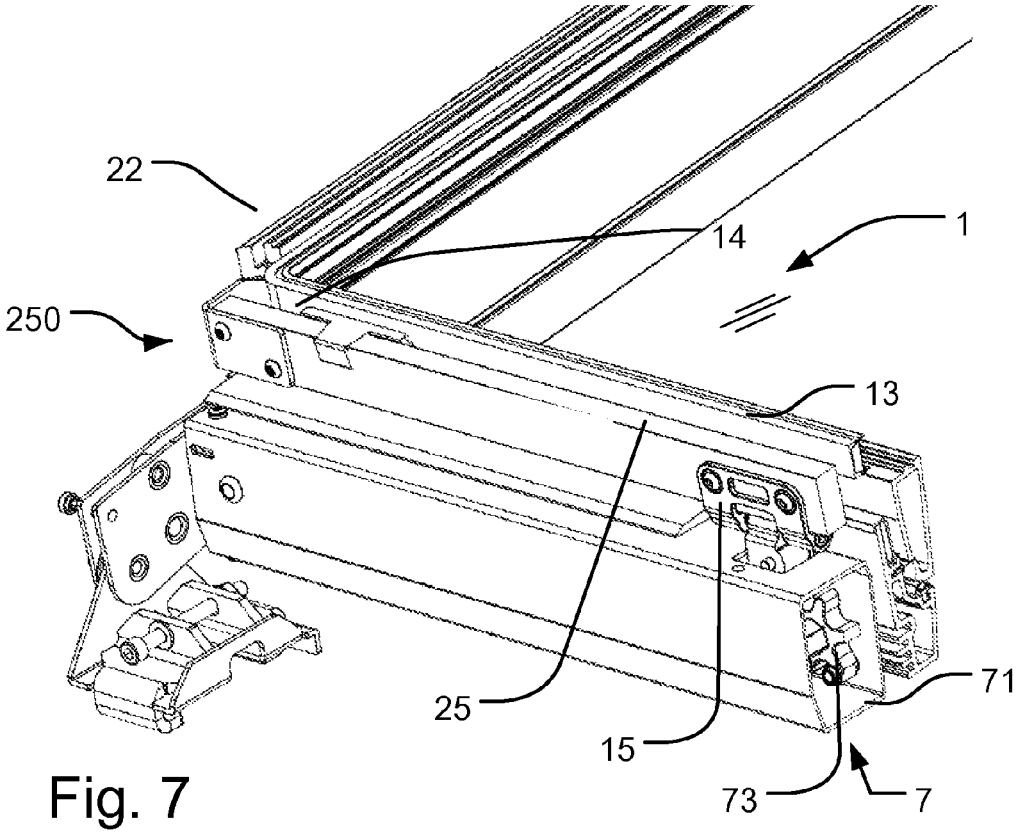
FIG. 7 is a view corresponding to FIG. 6 with some parts removed.

In the perspective views of FIGS. 6 and 7, the exterior sheet element 12 and other parts have been removed for reasons of clarity.

In this embodiment, showing a window system for mounting in an inclined surface of a building, the window comprises a frame structure 3 including a plurality of frame members of which the bottom frame member 31 and one side frame member 32 are shown, and a sash structure 2 including a plurality of sash members of which the side sash member 22 is shown and the bottom sash member may be configured as the bottom sash member 21 of the embodiment described in the above and shown in FIG. 3.

As in the above embodiment, the frame structure and the sash structure each defines a substantially rectangular unit with an inner opening, a lower edge intended to face downwards in the mounted state of the window, an upper edge intended to face upwards in the mounted state of the window, and two side edges extending between the lower and upper edges.

A pane element 1 having an upper edge, a lower edge and two side edges is provided, which may be a stepped pane as indicated in the embodiment described in the above and shown in FIGS. 1 to 5, of which only the interior sheet element 11 and the spacer 13 are shown.

The window system in this embodiment comprises at least one operator 7 as well, arranged at the lower edge of the frame structure on an outer side thereof opposite the inner opening to cooperate with the yoke 25. The operator 7 is in this embodiment shown as an active operator, comprising an operator chain 73 in the operator housing 71. However, in case of the window system being mounted as a passive window system the operator and its members may be dispensed with as well.

The transverse element extending between side members of the sash structure thus forms a yoke 25 in connection with the pane element 1 and acts as a support of the pane element to transfer at least part of the load of the pane element to the side members 22 of the sash structure 2.

At least one glazing support 14 is mounted on the yoke 25. Depending on the width of the window system, two or more glazing supports may be present along the length of the yoke 25. As shown in more detail in FIGS. 9 to 11, each glazing support 14 comprises, in the embodiment shown, a substantially plane abutment portion 141 in contact with the pane element 1 and a first engagement portion 142 adapted to engage the yoke 25. A second engagement portion 143 is present as well in the embodiment, and also a mounting recess 144 to ease manufacture and assembly. An inclined portion 145 forms the transition between the abutment portion 141 and the first engagement portion 142.

The glazing support 14 may be made of any suitable material, for instance a plastic material which is easily mouldable or manufactured in any other suitable manner. To increase the strength, the glazing support 14 comprises a plurality of reinforcing ribs 146.

In the embodiment shown, the glazing support 14, or each glazing support, abuts the lower edge of the interior sheet element 11 and the spacer 13. However, in other configurations, the glazing support may abut other portions of the pane element and in other manners, for instance by adhesion or clamping.

A glazing support 14 may as well be positioned at both corners edges of the pane element 1, such as to abut both lower edges of the interior sheet element 11 and the spacer 13. It should also be noted that the glazing support 14 may only be present at the lower corners of the pane element 1, but is not limited hereto.

Referring now in particular to FIGS. 6 to 7, it is shown how the yoke 25 is mounted to the side members (referenced 22 in FIG. 3) of the sash structure 2 by means of a set of yoke fittings 250 having a generally angular shape. The yoke fitting 250 at the other corner, i.e. right-hand lower corner, is mirror-imaged as compared to the yoke fitting 250 shown.

Figure 8:
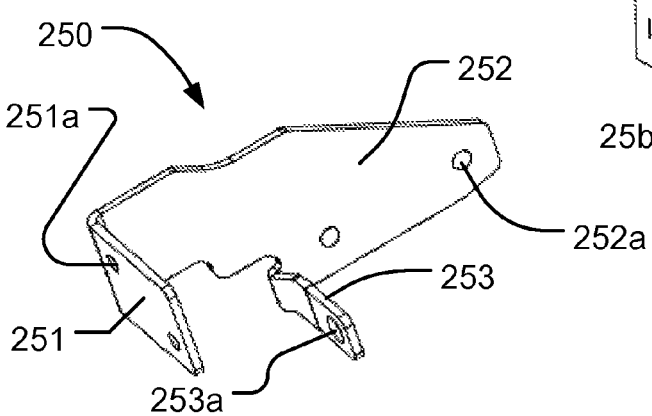
FIG. 8 is a perspective view of the yoke fitting in an embodiment of the window system according to the invention.
Figure 9:
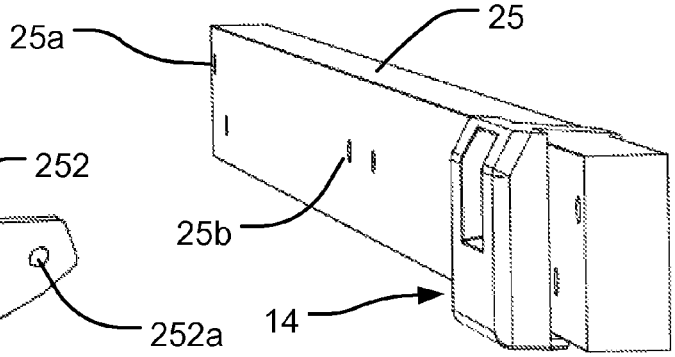
FIG. 9 is a perspective view of the yoke and glazing support in an embodiment of the window according to the invention.
Figure 10:
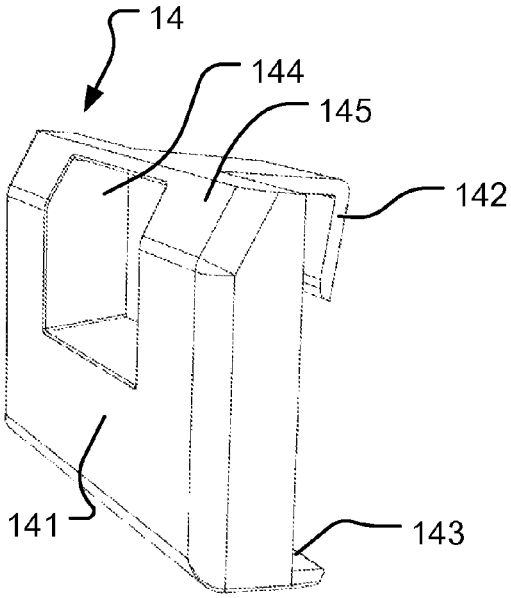
FIGS. 10 and 11 are perspective views, on a larger scale, of the glazing support in an embodiment of the window according to the invention.
Figure 11:
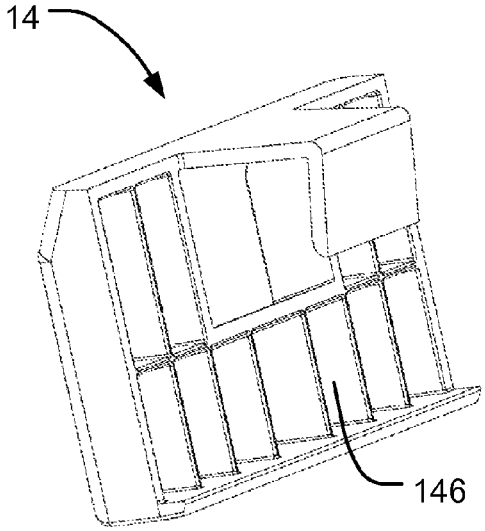

As shown in the detailed view of FIG. 8, each yoke fitting 250 has a first leg 251 for engagement with the yoke 25, and a second leg 252 for engagement with the sash side member 22. The first leg 251 is provided with engagement means 251*a* adapted to cooperate with corresponding engagement means 25*a* (FIG. 9) in the yoke 25, and the second leg 252 has engagement means 252*a* adapted to cooperate with corresponding not-shown engagement means in the sash side member. The engagement means may typically be formed as through apertures to receive bolts or rivets. As indicated, the first leg 251 of the yoke fitting 250 abuts the lower side of the yoke 25, i.e. the side facing away from the opening of the sash structure 2 to support the yoke 25 in a positive engagement, thus increasing the strength of the support of the pane element 1.

In the embodiment shown, the sash structure comprises a sash bottom member 21 and the yoke fitting 250 comprises a flange 253 adapted to engage with the sash bottom member 21. As shown, the flange 253 is provided with engagement means 253*a* adapted to cooperate with corresponding engagement means in the sash bottom member, such as with a bolt or rivet connection.

In addition to the yoke 25 functioning as a support and load bearing of the pane element 1, the yoke 25 is also connected to the operator 7, through which it transfers energy to the corners of the window, in case of an active window. Best illustrated in FIG. 7 is it seen how an operator bracket 15 thorough engagement means 25*b* (FIG. 9) connects with the yoke 25. Connected to the operator bracket is a chain 73, which is housed in the operator 7. Through the chain 73, energy is transferred from the operator 7 to the operator bracket 15, which thereby transfers energy to the entire length of the yoke 25 providing it with the necessary force to open the window. The yoke 25 may be formed in any suitable manner and is in the embodiment shown formed as a generally longitudinal bar of a material such as metal. The generally longitudinal bar constituting the yoke 25 has a rectangular cross-section, preferably of dimensions 10-30 mm by 30-60 mm, here as 15 mm by 35 mm. The yoke 25 should have sufficient strength, in particular bending resistance, to withstand the load emanating from the weight of the pane element and of any other forces that the sash may be subjected to.

In the embodiment shown, the yoke 25 is located on the interior side of the lower edge of the pane element 1 which as shown is provided in that the one sheet element, namely the exterior sheet element 12 of the pane element 1, projects over the lower edges of the sash structure and the frame structure away from the inner opening, and the yoke 25 is positioned below the projecting exterior sheet element 12 on the interior side of the lower edge thereof, and on the exterior side of the lower edge of another sheet element, that is the interior sheet element 11 of the pane element 1.

It should be noted that the above description of presently preferred embodiments serves only as an example, and that a person skilled in the art will know that numerous variations are possible without deviating from the scope of the claims.

The invention claimed is:

1. A window system for mounting in an inclined surface of a building, said window system comprising:

a frame structure including a plurality of frame members and a sash structure including a plurality of sash members, said plurality including at least two sash side members (22) and a sash bottom member (21), the frame structure and the sash structure each defining a substantially rectangular unit with an inner opening, a lower edge intended to face downwards in the mounted state of the window, an upper edge intended to face upwards in the mounted state of the window, and two side edges extending between the lower and upper edges, and a pane element (1) having an upper edge, a lower edge and two side edges, and a transverse element extending between the side members of the sash structure at the lower edge of the pane element (1), between the sash bottom member (21) and a frame extension element (35) and extending parallel to the sash bottom member (21), forming a yoke (25) in connection with the pane element (1) and acting as a support of the pane element (1) to transfer at least part of the load of the pane element to the side members (22) of the sash structure (2), thus dispensing with the supporting function of the sash bottom member (21), either in part or in full.

2. A window system according to claim 1, wherein at least one glazing support (14) is mounted on the yoke (25).

3. A window system according to claim 2, wherein each glazing support (14) comprises a substantially plane abutment portion (141) in contact with the pane element (1) and a first engagement portion (142) adapted to engage the yoke (25).

4. A window system according to claim 3, wherein each glazing support (14) comprises a second engagement portion (143).

5. A window system according to claim 2, wherein each glazing support (14) comprises a plurality of reinforcing ribs (146).

6. A window system according to claim 1, wherein the yoke (25) is mounted to the side members (22) of the sash structure (2) by means of a set of yoke fittings (250) having a generally angular shape.

7. A window system according to claim 6, wherein each yoke fitting (250) has a first leg (251) for engagement with the yoke (25), and a second leg (252) for engagement with the sash side member (22).

8. A window system according to claim 7, wherein the first leg (251) is provided with engagement means (251*a*) adapted to cooperate with corresponding engagement means (25*a*) in the yoke (25), and the second leg (252) has engagement means (252*a*) adapted to cooperate with corresponding engagement means in the sash side member.

9. A window system according to claim 6, wherein the yoke fitting (250) comprises a flange (253) adapted to engage with the sash bottom member (21) of the sash structure.

10. A window system according to claim 1, wherein the yoke (25) is formed as a generally longitudinal bar of a material such as metal.

11. A window system according to claim 10, wherein the generally longitudinal bar constituting the yoke (25) has a rectangular cross-section.

12. A window system according to claim 1, wherein the yoke (25) is located on the interior side of the lower edge of the pane element (1).

13. A window system according to claim 12, wherein at least one sheet element (12) of the pane element (1) projects over the lower edges of the sash structure and the frame structure away from the inner opening, the yoke (25) being positioned below said at least one projecting sheet element (12) on the interior side of the lower edge thereof, and on the exterior side of the lower edge of another sheet element (11) of the pane element (1).

14. A window system according to claim 1, wherein at least one operator is arranged at the lower edge of the frame structure on an outer side thereof opposite the inner opening to cooperate with the yoke (25) extending between side members of the sash structure.

15. A window system according to claim 3, wherein each glazing support (14) comprises a plurality of reinforcing ribs (146).

16. A window system according to claim 4, wherein each glazing support (14) comprises a plurality of reinforcing ribs (146).

17. A window system according to claim 2, wherein the yoke (25) is mounted to the side members (22) of the sash structure (2) by means of a set of yoke fittings (250) having a generally angular shape.

18. A window system according to claim 3, wherein the yoke (25) is mounted to the side members (22) of the sash structure (2) by means of a set of yoke fittings (250) having a generally angular shape.

19. A window system according to claim 5, wherein the yoke (25) is mounted to the side members (22) of the sash structure (2) by means of a set of yoke fittings (250) having a generally angular shape.

20. A window system according to claim 7, wherein the yoke fitting (250) comprises a flange (253) adapted to engage with the sash bottom member (21) of the sash structure, the flange (253) being preferably provided with engagement means (253*a*) adapted to cooperate with corresponding engagement means in the sash bottom member.

21. A window system according to claim 4, wherein each glazing support (14) further comprises a mounting recess (144).

22. A window system according to claim 4, wherein each glazing support (14) further comprises an inclined portion (145) forming a transition between the abutment portion (141) and the first engagement portion (142).

23. A window system according to claim 9, wherein the flange (253) is provided with engagement means (253*a*) adapted to cooperate with corresponding engagement means in the sash bottom member.

24. A window system according to claim 11, wherein the rectangular cross-section of the yoke (25) has dimensions of 10-30 mm by 30-60 mm.

25. A window system according to claim 24, wherein the rectangular cross-section of the yoke (25) has dimensions of 15 mm by 35 mm.

* * * * *